US005922132A

United States Patent [19]

Martel

[11] Patent Number: 5,922,132

[45] Date of Patent: Jul. 13, 1999

[54] AUTOMATED ADHESIVE SPRAY TIMING CONTROL

[75] Inventor: Thomas Martel, DeWitt, N.Y.

[73] Assignee: K-G Devices Corporation, DeWitt, N.Y.

[21] Appl. No.: 08/867,505

[22] Filed: Jun. 2, 1997

[51] Int. Cl.[6] ..... B05C 11/00

[52] U.S. Cl. ..... 118/703; 118/712; 118/679

[58] Field of Search ..... 118/712, 669, 118/671, 672, 673, 676, 679, 684, 682, 686, 324, 703; 156/350, 351, 356, 357, 366, 367, 378, 578; 250/559.15, 559.13, 559.29, 559.32, 559.4; 356/429

[56] References Cited

U.S. PATENT DOCUMENTS 4,500,937 2/1985 Matt ..... 118/684
5,380,366 1/1995 Becker et al. ..... 118/712

*Primary Examiner*—David A. Simmons
*Assistant Examiner*—Calvin Padgett
*Attorney, Agent, or Firm*—George R. McGuire

[57] ABSTRACT

A system for improving accuracy of application of a fluid to a desired area of an object which is moving transversely to the direction in which the fluid, e.g., an adhesive, is emitted from a nozzle via an electrically actuated valve. Photoelectric or other such detecting means are positioned in known distance from the nozzle to generate a signal in response to presence of fluid at that position. The delay time between detection of the moving object at a predetermined position and generation of the signal to open the valve is varied commensurately with the time period between generation of the valve-opening and fluid-detection signals of the preceding cycle. The variable delay time thus reflects more accurately the actual electrical and mechanical response times of the valve as opposed to an estimated, fixed delay time. A second detector may be spaced a predetermined distance along the path of adhesive flow from the first detector to provide measurement of fluid velocity.

13 Claims, 2 Drawing Sheets

AUTOMATED ADHESIVE SPRAY TIMING CONTROL

BACKGROUND OF THE INVENTION

The present invention relates to controlling the timing of sequential emissions of a liquid from a spray head, or the like; more specifically, the invention relates to automated control of the time interval between emissions of a liquid, e.g., an adhesive, ink, paint, etc., which is directed from a solenoid-actuated nozzle to a succession of items which are moving in spaced relation to one another and to the nozzle transversely to the direction of travel of the liquid.

For purposes of the present discussion, the liquid applied from the spray head will be assumed to be an adhesive. Liquid adhesives are commonly applied in the form of a spray to predetermined areas of items which are moved past a spray head in a direction perpendicular (or otherwise non-parallel) to the direction in which the adhesive spray is emitted. In automated packaging systems, for example, adhesive is applied by a spray head to designated areas of boxes, cartons, or other containers, which are then adhered to an opposing surface to effect closure of the container. There are, of course, many other industrial applications of the automated application of liquid adhesive in spray form to the areas requiring adhesion to one or more other items or areas.

Typical automated adhesive spray installations include a spray head, including nozzle and solenoid-actuated valve, a photodetector and a control unit. Liquid adhesive is supplied to the head under pressure and is emitted in a predetermined pattern through the nozzle when the valve is open. The photodetector is positioned to generate a signal in response to the leading edge, or other portion of the item to which adhesive is to be applied, passing a predetermined point as it is moved, e.g., on a conveyor belt, in a path through the adhesive application area. The photodetector signal is applied to the control unit which actuates the solenoid.

In order to ensure that the adhesive is applied to the desired target area, and only to this area, precise timing of opening and closing of the valve is required, also taking into account the distance of travel and velocity of the adhesive. Although the distance is a known and essentially non-variable parameter, velocity is influenced by such factors as delivery pressure, temperature and viscosity of the liquid adhesive, any of which may be subject to fluctuations. In addition to variations in adhesive velocity, electrical and mechanical response times of the solenoid coil and associated valve will have an effect on the area of application of the adhesive. Typical packaging applications require timing accuracy within 5 milliseconds, and tolerances of plus or minus one millisecond of the ideal timing are not uncommon.

It is the current practice to measure the factors influencing the proper timing of valve opening and closing, and apply a fixed compensation factor via the control unit. That is, the time-off-light of the adhesive from the nozzle to the target, the delay due to inductance of the solenoid coil and the mechanical response time of the valve are lumped together and a single time value, typically 8 to 20 milliseconds, is applied as what is termed a head compensation or "head comp" factor.

In typical installations, head comp settings and adjustments are made by a technician observing the area of adhesive application with a strobe light when the production line is at full speed operation. Although such head comp settings may be reasonably accurate at the moment they are made, besides being subject to human error they may be invalid in a relatively short time due to fluctuations in one or more of the aforementioned parameters. This leads to errors in positioning of the area of adhesive application which are amplified as the speed of production increases.

Accordingly, it is a principal object of the present invention to provide a novel and improved system for controlling the application of liquid from a spray head to a moving item, ensuring accurate application of adhesive to a desired target area.

Another object is to provide an automated method of adjusting the head comp setting of a liqiud spray head.

A further object is to provide an automated system for delay-compensated control of a liquid spray installation with the capability of monitoring ejection of adhesive from the spray head.

Other objects will in part be obvious and will in part appear hereinafter.

SUMMARY OF THE INVENTION

The control system of the invention includes two spray detection means spaced from one another in the direction of spray travel. Each of the detection means is adapted to discriminate between presence and absence of adhesive spray at a discrete point along the path of travel of the spray. For example, each detection means may comprise an emitter-detector pair wherein the emitter directs a beam of light, sound or ultrasound toward the detector. The beam is interrupted or otherwise altered in a manner discernable by the detector by passage therethrough of the adhesive spray.

Positioning two detection means a known distance apart permits exact calculation of the velocity of the adhesive stream and thus its time-of-flight across the known distance from the spray head nozzle to the target. Delay due to solenoid coil inductance and mechanical response time are also accurately monitored by the time difference sensed by the first (or, if desired, the second) of the detection means. In addition to the enhanced accuracy of positioning of the adhesive on the target area, the system provides a convenient means of monitoring a failure to eject adhesive when the valve is opened due to exhaustion of adhesive supply, failure of pressurizing system, clogging of spray nozzle, etc.

The foregoing and other features of the adhesive spray system and method of operation will be more readily understood and fully appreciated from the following detailed description, taken in conjunction with the accompanying drawings.

DETAILED DESCRIPTION

Figure 1:
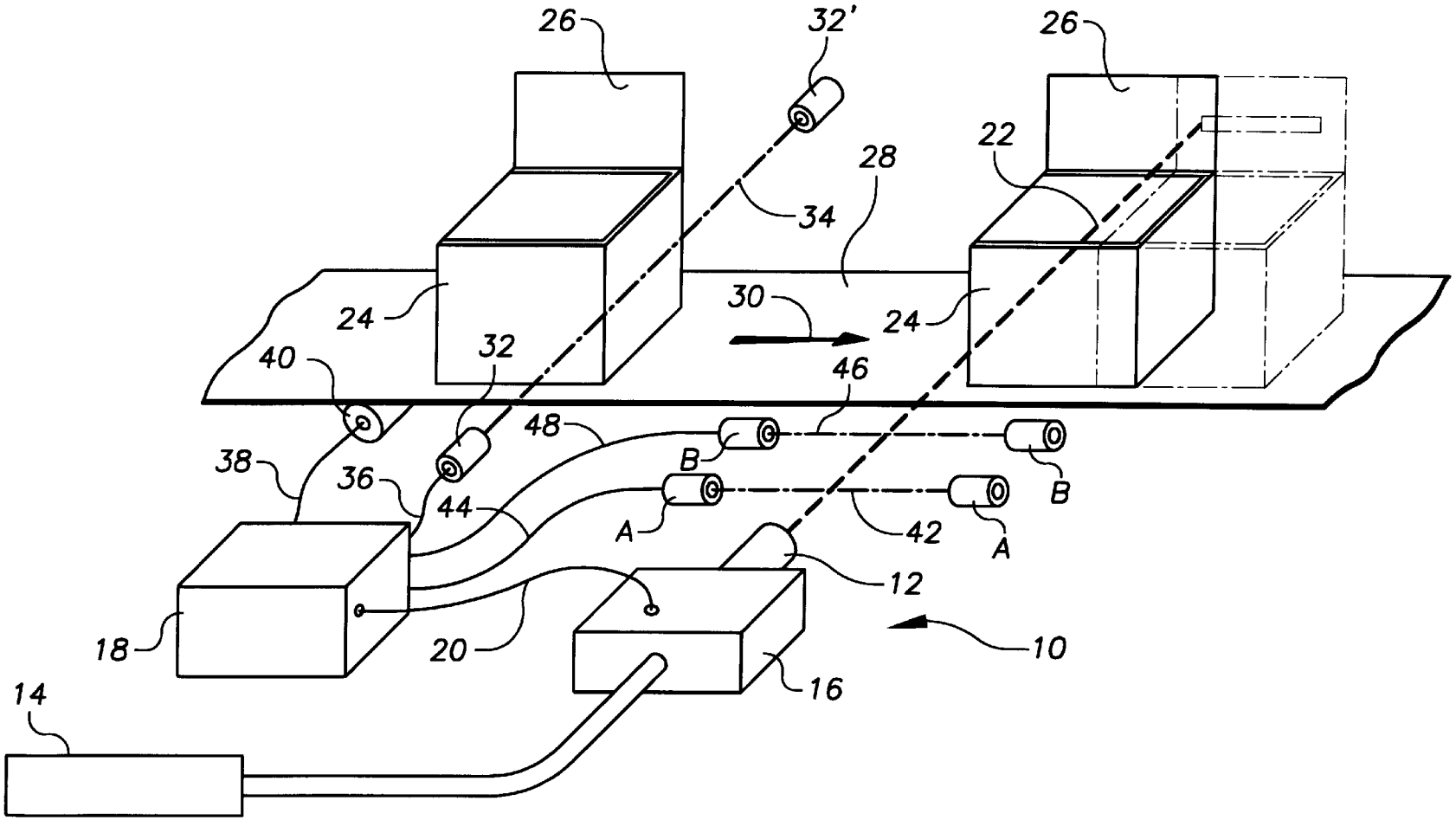
FIG. 1 is a somewhat diagrammatic, perspective view of an automated adhesive spray system incorporating the features of the present invention.

Referring now to the drawings, conventional adhesive spray head 10 includes nozzle 12 to which liquid adhesive under pressure is supplied from source 14 through solenoid-operated valve 16. Valve 16 is responsive to electrical signals from control unit 18 via line 20. Head 10 is positioned to direct a stream of adhesive in a path indicated by dashed line 22. A succession of items 24, each having a portion 26 to which adhesive is to be applied over a predetermined area, are moved, for example, upon conveyor belt 28, in a direction indicated by arrow 30, perpendicular to adhesive path 22. Items 24 are illustrated as cardboard cartons having flaps 26 which are to be held in a closed position by the adhesive, but the nature of the items, of course, has no bearing on the invention. Furthermore, although spray head 10 will in most cases be stationary as items 24 are moved by suitable conveying means, any means of effecting relative movement between the path of adhesive spray and the target areas to which the adhesive is applied is considered to be within the scope of the invention.

Conventional positional detecting means, such as a photoelectric emitter-detector pair indicated diagrammatically by reference numerals 32, 32', are positioned and adapted to generate an electrical signal in response to passage of the leading edge, or other predetermined portion, of each of items 24 through a beam 34. Signals from detecting means 32, 32' are supplied via line 36 as an input to control unit 18. A further input to control unit 18 is supplied via line 38 from sensing means 40 which generates signals commensurate with the speed of travel of conveyor belt 28, and thus of items 24.

Typical prior art systems are comprised of the elements thus far described. The signal generated by detector pair 32, 32' is applied via line 36, as well as the velocity signal via line 38, to control unit 18 which in turn applies an actuating signal to the solenoid coil of valve 16 after a selectively adjustable time delay. The valve opens after the signal is applied and after the additional time delay due to inductance of the solenoid coil and mechanical response time of the movable elements. Adhesive is applied to the target area for the time period that the valve is open, with a delay between beginning and ending of application equal to the time-of-flight of the adhesive from the nozzle to the target.

The target, being a portion of the item moving perpendicularly to the path of the adhesive spray, is moving at a velocity commensurate with the signal supplied on line 38 to control unit 18. Thus, the time period during which the valve should remain open is established by dividing the known length of the target area by its velocity, as indicated by the signal on line 38. Parameters such as the opening and closing response times of the valve and time-of-flight of the adhesive are taken into account by manual adjustment of the variable delay time between application of a signal to the solenoid coil on line 20. This adjustment is performed by a technician while visually observing, with the aid of a strobe light, the application of adhesive to target areas moving past the spray head. Adjustment of the variable time delay continues until the observed position of adhesive application corresponds to the desired target area.

Control of adhesive spray timing by visual observation and manual adjustment provides satisfactory results as long as there is no significant change in the operating parameters which have an effect on the timing. However, such things as temperature, viscosity and delivery pressure of the adhesive, as well as mechanical response time of the valve, are subject to fluctuations during operation of the system and may affect the timing of adhesive application. Therefore, monitoring and adjustment of the control system must be performed frequently, if not continuously, in order to maintain the required level of accuracy.

The present invention addresses this problem by providing two detection means, denoted A and B in FIG. 1, each comprising an emitter-detector pair, positioned to detect the presence of adhesive spray at spaced positions along path 22. In the illustrated embodiment, detection means A and B operate optically. When light beam 42 of detection means A is intercepted by adhesive spray, a signal is generated and applied via line 44 to control unit 18. Likewise, interruption of beam 46 by adhesive spray causes detection means B to generate a signal which is applied to control unit 18 via line 48. The distances along path 22 from nozzle 12 to beam 42, and from beam 42 to beam 46 are, of course, known and fixed. This permits calculations on a real-time basis to be made in control unit 18, and adjustments of the variable time delay to be made automatically on a continuing basis.

Figure 2:
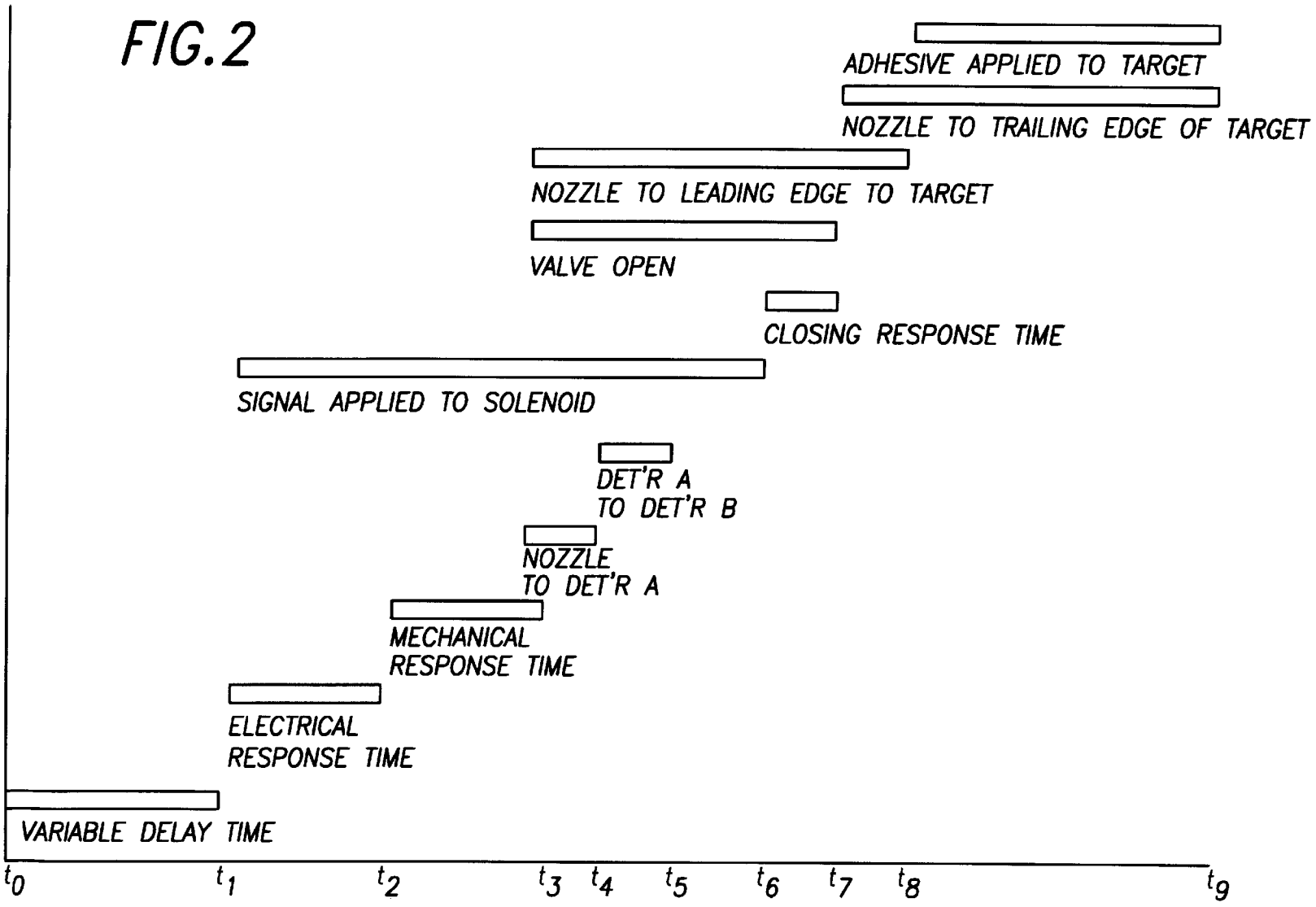
FIG. 2 is a timing diagram.

Referring now to FIG. 2, the leading edge of an item 24 breaks beam 34 and a signal is supplied to control unit 18 via line 36 at time $t_0$. The variable time delay between application of this signal to the control unit and application of a signal via line 20 to the solenoid coil of valve 16 is represented by $t_1-t_0$. The electrical response time due to coil inductance and mechanical response time of valve 16 are represented by $t_2-t_1$ and $t_3-t_2$, respectively. Thus, valve 16 actually opens and emits adhesive spray at time $t_3$. The time-of-flight of adhesive from nozzle 12 to detector A, and from detector A to detector B, are represented by $t_4-t_3$ and $t_5-t_4$, respectively, the distances and thus the times being assumed to be equal in this example.

From the speed of travel of items 24, indicated by the signal on line 38, the time of travel of the target area from leading to trailing edge is known. This is equal to the time period for which valve 16 should remain open, represented in the example as $t_7-t_3$. Accordingly, the actuating signal to the solenoid coil is removed at time $t_6$ and valve 16 closes at time $t_7$. The velocity of the adhesive stream is determined by dividing the known distance between beams 42 and 46 by the time between signals over lines 44 and 48, i.e., $t_5-t_4$. The time-of-flight of adhesive over the known distance from nozzle 12 to the target may then be calculated and, in the example, is equal to $t_8-t_3$ and $t_9-t_7$ to the leading and trailing edges, respectively, of the target area. Since adhesive reaches the target area at time $t_8$, and application of adhesive stops at time $t_9$, adhesive is being applied between times $t_8$ and $t_9$, a time period equal to that for which valve 16 is open ($t_9-t_8=t_7-t_3$).

It will be understood that the timing diagram of FIG. 2 is intended only to illustrate the principles of the invention. Other than the fact that valve-open time remains equal to adhesive-application time, and the time-of-flight of adhesive is the same from nozzle to target leading edge as to trailing edge ($t_8-t_3=t_9-t_7$) the indicated length of any given period, individually or in relation to the lengths of other periods, may vary considerably. As previously mentioned, velocity of the adhesive stream is determined in a continuous manner by dividing the time period between generation of signals on lines 44 and 48 ($t_5-t_4$, which may vary) by the known distance along path 22 between beams 42 and 46 (which is fixed). This permits monitoring of the time-of-flight from the nozzle to the leading and trailing edges of the target area. Adhesive velocity and time-of-flight are, of course, inversely proportional. Thus, as velocity increases, time-off-flight to the leading target edge ($t_8-t_3$) decreases. In the example, it is assumed that the speed of travel of items 24 will place the leading edge of the target area in position to be contacted by adhesive at time $t_8$. Therefore, the time of valve opening needs to be delayed past time $t_3$ by an interval commensurate with the increase in adhesive velocity. A microprocessor within control unit 18 is programmed to extend the variable delay time ($t_1-t_0$) by an appropriate amount so that the valve is opened at a time later than $t_3$ to cause adhesive to arrive at the leading edge of the target area at the desired time $t_8$.

Although electrical response time ($t_2-t_1$) can be expected to remain essentially constant, mechanical response time ($t_3$–$t_2$) can vary substantially. The total of these two delays ($t_3$–$t_1$) is monitored by measuring the time period between generation of the valve-opening signal on line 20 and detection of adhesive signal on line 44. That is, the time delay ($t_1$–$t_0$), although variable, is known at any given time; likewise, the time-of-flight of adhesive over the known distance from nozzle 12 to beam 42 is determined from the continuously monitored velocity of the adhesive. Thus, by subtracting the delay time ($t_1$–$t_0$) and time-of-flight from nozzle 12 to beam 42 ($t_4$–$t_3$) from the time between generation of signals on lines 36 and 44 ($t_4$–$t_0$), the combined electrical and mechanical response times ($t_3$–$t_1$) may be calculated. Variations in response time are processed by control unit 18 and the variable delay time is adjusted accordingly to cause valve 16 to open and adhesive to arrive at the leading edge of the target area at the proper time.

Although the invention has been shown and described in a preferred embodiment, it will be understood that substitutions and modifications may be made within the scope of the invention. For example, although detection means A and B are indicated to be a conventional, optical emitter-detector pair, the passage of adhesive may be detected by other means, such as ultrasonic, acoustic or capacitive sensors. It should also be noted that, while the indicated purpose of the invention is automated control of the timing of an adhesive spray system, an additional benefit is a continuing, positive and immediate indication of actual emission of adhesive. That is, should nozzle 12 become clogged, the supply of adhesive from source 16 be exhausted, or valve 16 malfunction, the lack of a signal on line 44 (and/or line 48) after a predetermined time interval would provide an indication of the unintended interruption of adhesive spray. Such information may be vital in situations such as application of adhesive in sterile packaging. For this purpose, as well as for monitoring the response times of the valve, only a single detecting unit would be required. This is considered an aspect of the invention, the use of a pair of detectors providing the added capability of determining the velocity, and thus time-of-flight, of the liquid.

What is claimed is:

1. In a system for controlling successive, time-spaced emissions of discrete fluid stream, each having a leading and a trailing end through a nozzle along a linear path by alternately opening and closing an electrically actuated valve connected to said nozzle, the improvement comprising:

a) first means for generating a first electrical signal in response to each occurrence of a repeated event;

b) second means for generating a second electrical signal following generation of said first signal by a controlled, variable delay time period, said valve being actuated to open following generation of said second signal by an uncontrolled, variable response time period;

c) third means for generating a third electrical signal in response to presence of said fluid stream at a predetermined location in said linear path following opening of said valve;

d) fourth means for automatically varying the duration of said delay time period between generation of said first and second signals in response to variations in the time period between generation of said second and third signals to maintain the duration of the time period between successive generations of said first and third signals substantially constant; and e) fifth means for effecting closing of said valve a fixed time period after generation of said second signal.

2. The improvement according to claim 1 wherein said fluid streams are applied to target areas of a succession of objects during relative movement of said nozzle and objects transversely to said linear path.

3. The improvement according to claim 2 wherein said repeated event is a predetermined positional relationship of said nozzle and each of said successive objects during said relative movement.

4. The improvement according to claim 3 wherein said nozzle is stationary and further including means for moving said objects transversely to said linear path with said target areas successively intersecting said linear path.

5. The improvement according to claim 4 and further including means for continuously monitoring the velocity of said objects.

6. The improvement according to claim 4 wherein said first means comprise means for detecting passage of a predetermined portion of each of said objects past a specified position.

7. The improvement according to claim 1 wherein said third means comprises means for directing a first beam of wave energy to intersect said linear path at a first point forwardly of said nozzle, said beam being broken by said leading end of said fluid stream to generate said third signal.

8. The improvement according to claim 7 and further including means for directing a second beam of a wave energy to intersect said linear path at a second point, a known distance forwardly of said first point, said second beam being broken by said leading end of said fluid stream to generate a further electrical signal, and means for measuring the duration of the time period between generation of said third and said further electrical signals.

9. The improvement according to claim 8 and further including means for calculating the velocity of said fluid streams from said time period between said third and further signals and said known distance between said first and second points.

10. In a system for emitting successive, discrete streams of fluid along a linear path from a nozzle to individual target areas during relative movement of said nozzle and target areas transversely to said linear path, emission of said fluid stream being started and stopped by alternate opening and closing of an electrically actuated valve through which said fluid is supplied under pressure to said nozzle, the improvement comprising:

a) first means for generating a first electrical signal in response to said nozzle and target reaching a predetermined positional relationship of said relative movement;

b) second means for generating a second electrical signal an adjustable time period after generation of said first signal, said second signal being applied to actuate and open said valve for emission of a first fluid stream from said nozzle;

c) third means for generating a third electrical signal in response to the leading edge of said first fluid stream reaching a predetermined position in said linear path;

d) fourth means for generating a fourth electrical signal proportionate to the velocity of said first fluid stream; and e) fifth means for varying the duration of said adjustable time period in inverse proportion to variations in said velocity.

11. The improvement according to claim 10 wherein said nozzle is stationary and said target areas are moved in a second path, perpendicular to said linear path, and further including means for continuously monitoring the velocity of said target areas.

12. The improvement according to claim 10 wherein said fourth means comprises means for generating a fifth electrical signal in response to the leading edge of said first fluid stream reaching a second position in said linear path, said second position being a known distance from said predetermined position.

13. The improvement according to claim 12 wherein said means for generating said third and fifth signals comprise means for directing respective beams of wave energy to intersect said linear path and be interrupted by said fluid stream at said predetermined and second positions.

* * * * *